US005704000A

United States Patent [19]

Swaminathan et al.

[11] Patent Number: 5,704,000

[45] Date of Patent: Dec. 30, 1997

[54] ROBUST PITCH ESTIMATION METHOD AND DEVICE FOR TELEPHONE SPEECH

[75] Inventors: Kumar Swaminathan, Gaithersburg; Murthy Vemuganti, Germantown, both of Md.

[73] Assignee: Hughes Electronics, Los Angeles, Calif.

[21] Appl. No.: 337,595

[22] Filed: Nov. 10, 1994

[51] Int. Cl.[6] ..... G10L 5/00

[52] U.S. Cl. ..... 395/2.16; 395/2.77

[58] Field of Search ..... 381/38, 49; 395/216, 395/217, 218, 2.25, 2.27, 2.26, 2.77, 2.3

[56] References Cited

U.S. PATENT DOCUMENTS

| | | | |
|---|---|---|---|
| 3,947,638 | 3/1976 | Blankinship | 395/2.16 |
| 4,004,096 | 1/1977 | Bauer et al. | 395/2.16 |
| 4,468,804 | 8/1984 | Kates et al. | 395/2.74 |
| 4,625,286 | 11/1986 | Papanichalis et al. | 395/2.28 |
| 4,653,098 | 3/1987 | Nakata et al. | 381/49 |
| 4,696,038 | 9/1987 | Doddington et al. | 381/38 |
| 4,731,846 | 3/1988 | Secrest et al. | 395/2.16 |
| 4,791,671 | 12/1988 | Willems | 395/2.26 |
| 4,802,221 | 1/1989 | Jibbe | 381/34 |
| 4,852,179 | 7/1989 | Fette | 395/2 |
| 4,989,247 | 1/1991 | Van Hemert | 395/2.16 |
| 5,056,143 | 10/1991 | Taguchi | 395/2.3 |
| 5,233,660 | 8/1993 | Chen | 381/38 |
| 5,313,553 | 5/1994 | Laurent | 395/2.16 |
| 5,350,303 | 9/1994 | Fox et al. | 434/118 |

FOREIGN PATENT DOCUMENTS

| | | |
|---|---|---|
| 2057139 | 6/1992 | Canada . |
| 2670313 | 6/1992 | France . |

OTHER PUBLICATIONS

L.R. Rabiner and R.W. Schafer, *Digital Processing of Speech Signals*, Prentice–Hall, Inc., (1978), pp. 141–149.

Pope, Solberg, and Brodersen, "A Single–Chip Linear–Predictive–Coding Vocoder," I.E.E.E. Journal of Solid–State Circuits SC–22, No. 3 (Jun. 1987).

K. Swaminathan et al., "Speech and Channel Codec Candidate for the Half rate Digital Cellular Channel," ICASSP '94.

*Primary Examiner*—Allen R. MacDonald
*Assistant Examiner*—Donald L. Storm
*Attorney, Agent, or Firm*—John T. Whelan; Wanda Denson-Low

[57] ABSTRACT

A pitch estimating method includes the steps of (1) determining a set of pitch candidates to estimate a pitch of a digitized speech signal at each of a plurality of time instants, wherein series of these time instants define segments of the digitized speech signal; (2) constructing a pitch contour using a pitch candidate selected from each of the sets of pitch candidates determined in the first step; and (3) selecting a representative pitch estimate for the digitized speech signal segment from the set of pitch candidates comprising the pitch contour.

15 Claims, 6 Drawing Sheets

REPEAT FOR:

TIME INSTANT j = 3

PITCH CANDIDATE INDEX k = 1

BEFORE CALCULATING PATH METRIC FOR TIME INSTANT j = 4

ROBUST PITCH ESTIMATION METHOD AND DEVICE FOR TELEPHONE SPEECH

BACKGROUND OF THE INVENTION

Pitch estimation devices have a broad range of applications in the field of digital speech processing, including use in digital coders and decoders, voice response systems, speaker and speech recognition systems, and speech signal enhancement systems. A primary practical use of these applications is in the field of telecommunications, and the present invention relates to pitch estimation of telephonic speech.

The increasing applications for speech processing have led to a growing need for high-quality, efficient digitization of speech signals. Because digitized speech sounds can consume large amounts of signal bandwidths, many techniques have been developed in recent years for reducing the amount of information needed to transmit or store the signal in such a way that it can later be accurately reconstructed. These techniques have focused on creating a coding system to permit the signal to be transmitted or stored in code, which can be decoded for later retrieval or reconstruction.

One modern technique is known as Code Excited Linear Predictive coding ("CELP"), which utilizes an "excitation codebook" of "codevectors," usually in the form of a table of equal length, linearly independent vectors to represent the excitation signal. Recently developed CELP systems typically codify a signal, frame by frame, as a series of indices of the codebook (representing a series of codevectors), selected by filtering the codevectors to model the frequency shaping effects of the vocal tract, comparing the filtered codevectors with the digitized samples of the signal, and choosing the codevector closest to it.

Pitch estimation is a critical factor in accurately modeling and coding an input speech signal. Prior art pitch estimation devices have attempted to optimize the pitch estimate by known methods such as covariance or autocorrelation of the speech signal after it has been filtered to remove the frequency shaping effects of the vocal tract. However, the reliability of these existing devices are limited by an additional difficulty in accurately digitizing telephone speech signals, which are often contaminated by non-stationary spurious background noise and nonlinearities due to echo suppressors, acoustic transducers and other network elements.

Accordingly, there is a need for a method and device that accurately estimates the pitch of speech signals, in spite of the presence of non-stationary contaminants and distortion.

SUMMARY OF THE INVENTION

The present invention provides a pitch estimating method and device for estimating the pitch of speech signals, in spite of the presence of contaminants and distortions in telephone speech signals. More particularly, the present invention provides a pitch estimating method and device capable of providing an accurate pitch estimate, in spite of the presence of non-stationary spurious contamination, having potential use in any speech processing application.

Specifically, the present invention provides a method of estimating the pitch in a digitized speech signal comprising the steps of: (1) determining a set of pitch candidates to estimate a pitch of the digitized speech signal at each of a plurality of time instants, wherein series of these time instants define segments of the digitized speech signal; (2) constructing a pitch contour a pitch candidate selected from each of the sets of pitch candidates; and (3) selecting a representative pitch estimate for each digitized speech signal segment from the selected pitch candidates comprising the pitch contour.

Additionally, the present invention provides a pitch estimator for speech signals comprising a clock for measuring a series of time instants; a sampler coupled to the clock for receiving the speech signals and generating a series of digitized speech segments corresponding to the series of time instants received from the clock; a register for producing a plurality of different pitch candidates; a pitch candidate determinator coupled to the register for receiving the series of digitized speech segments and selecting a plurality of pitch candidates from the register to approximate pitch values for the digitized speech segments; a pitch contour estimator coupled to the pitch candidate determinator for constructing a pitch contour from the pitch candidates selected by the pitch candidate determinator; and a pitch estimate selector coupled to the pitch contour estimator for selecting a pitch estimate from the pitch contour representative of the digitized speech segments.

The invention itself, together with further objects and attendant advantages, will be understood by reference to the following detailed description, taken in conjunction with the accompanying drawings.

DETAILED DESCRIPTION OF THE DRAWINGS

The present invention is a pitch estimating method and device that provides a robust pitch estimate of an input speech signal, even in the presence of contaminants and distortion. Pitch estimation is one of the most important problems in speech processing because of its use in vocoders, voice response systems and speaker identification and verification systems, as well as other types of speech related systems currently used or being developed.

While the drawings present a conceptualized breakdown of the present invention, the preferred embodiment of the present invention implements these steps through program statements rather than physical hardware components. Specifically, the preferred embodiment comprises a digital signal processor TI 320C31, which executes a set of prestored instructions on a digitized speech signal, sampled at 8 kHz, and outputs a representative pitch estimate for every 22.5 msec segment of the signal. However, because one skilled in the art will recognize that the present invention may also be readily embodied in hardware, that the preferred embodiment takes the form of software program statements should not be construed as limiting the scope of the present invention.

Figure 1:
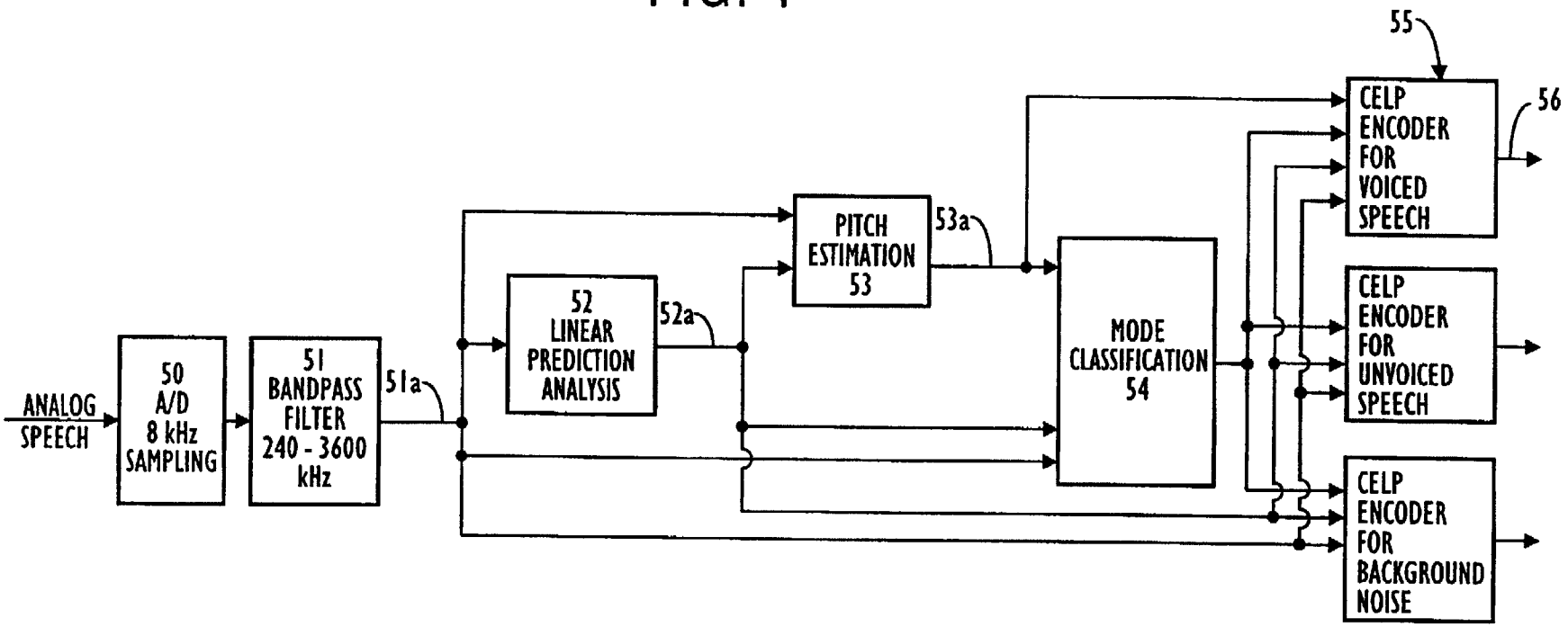
FIG. 1 is a block diagram illustrating application of the present invention in a low-rate multi-mode CELP encoder.

Turning now to the drawings, FIG. 1 is provided to illustrate a possible application of the present invention.

FIG. 1 shows use of the present invention in a low-rate multi-mode CELP encoder. As illustrated, a digitized, band-pass filtered speech signal 51*a* sampled at 8 kHz is input to the Pitch Estimation module 53 of the present invention. Also input to the Pitch Estimation module 53 are linear prediction coefficients 52*a* that model the frequency shaping effects of the vocal tract. These procedures are known in the art.

The Pitch Estimation module 53 of the present invention outputs a representative pitch estimate 53*a* for each segment of the input signal, which has two uses in the CELP encoder illustrated in FIG. 1: First, the representative pitch estimate 53*a* aids the Mode Classification module 54 in determining whether the signal represented in that speech segment consists of voiced speech, unvoiced speech or background noise, as explained in the prior art. See, for example, the paper of K. Swaminathan et al., "Speech and Channel Codec Candidate for the Half Rate Digital Cellular Channel," presented at the 1994 ICASP Conference in Adelaide, Australia. If the signal is unvoiced speech or background noise, the representative pitch estimate 53*a* has no further use. However, if the signal is classified as voiced speech, the representative pitch estimate 53*a* aids in encoding the signal, as indicated by the input to the CELP Encoder for Voiced Speech module 55 in FIG. 1, which then outputs the compressed speech 56. Those with ordinary skill in the art are aware that numerous encoding methods have been developed in recent years, and the above referenced paper further describes aspects of encoders.

After the speech signal is encoded as compressed speech 56, it may be stored or transmitted as required.

Figure 2:
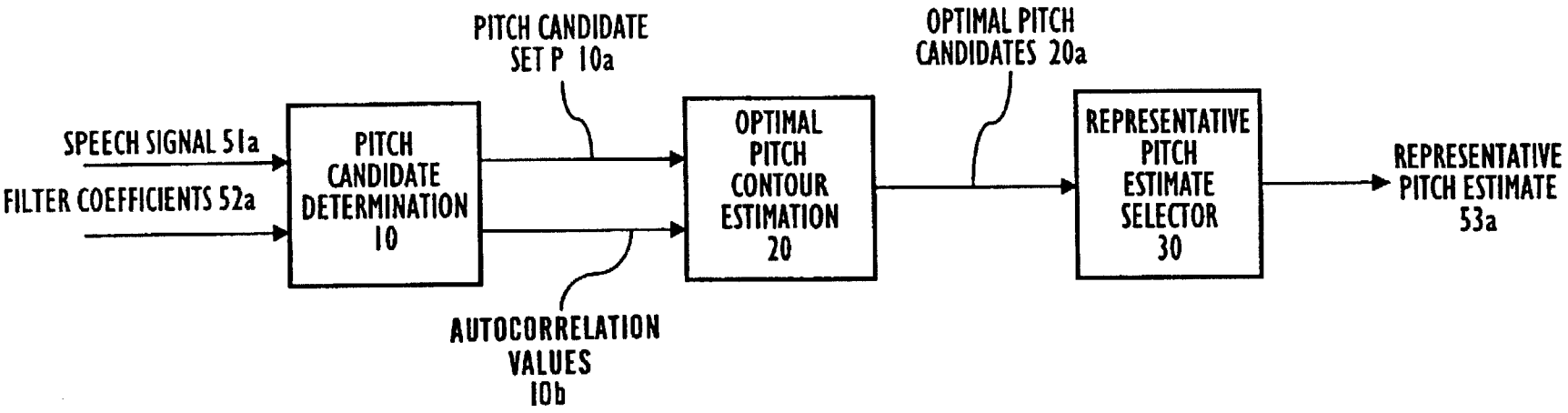
FIG. 2 is a block diagram illustrating the preferred method of pitch estimation in accordance with the present invention.

FIG. 2 shows a block diagram of the Pitch Estimation module 53 of FIG. 1, which is the focus of the present invention. As shown, after receiving the Speech Signal 51*a* and Filter Coefficients 52*a* resulting from the linear prediction analysis 52, the present invention estimates the signal pitch in three stages: First, the Pitch Candidate Determination module 10 determines a set of pitch candidates P 10*a* to represent the pitch of the speech signal 51*a*, and calculates autocorrelation values 10*b* corresponding to each member of the pitch candidate set P 10*a*. Second, the Optimal Pitch Contour Estimation module 20 selects optimal pitch candidates 20*a* from among pitch candidate set P 10*a* based in part on the autocorrelation values 10*b*. Finally, in the third stage, the Representative Pitch Estimate Selector module 30 selects a representative pitch estimate 53*a* from among the optimal pitch candidates 20*a* to provide an overall pitch estimation for the signal segment being analyzed.

Figure 3:
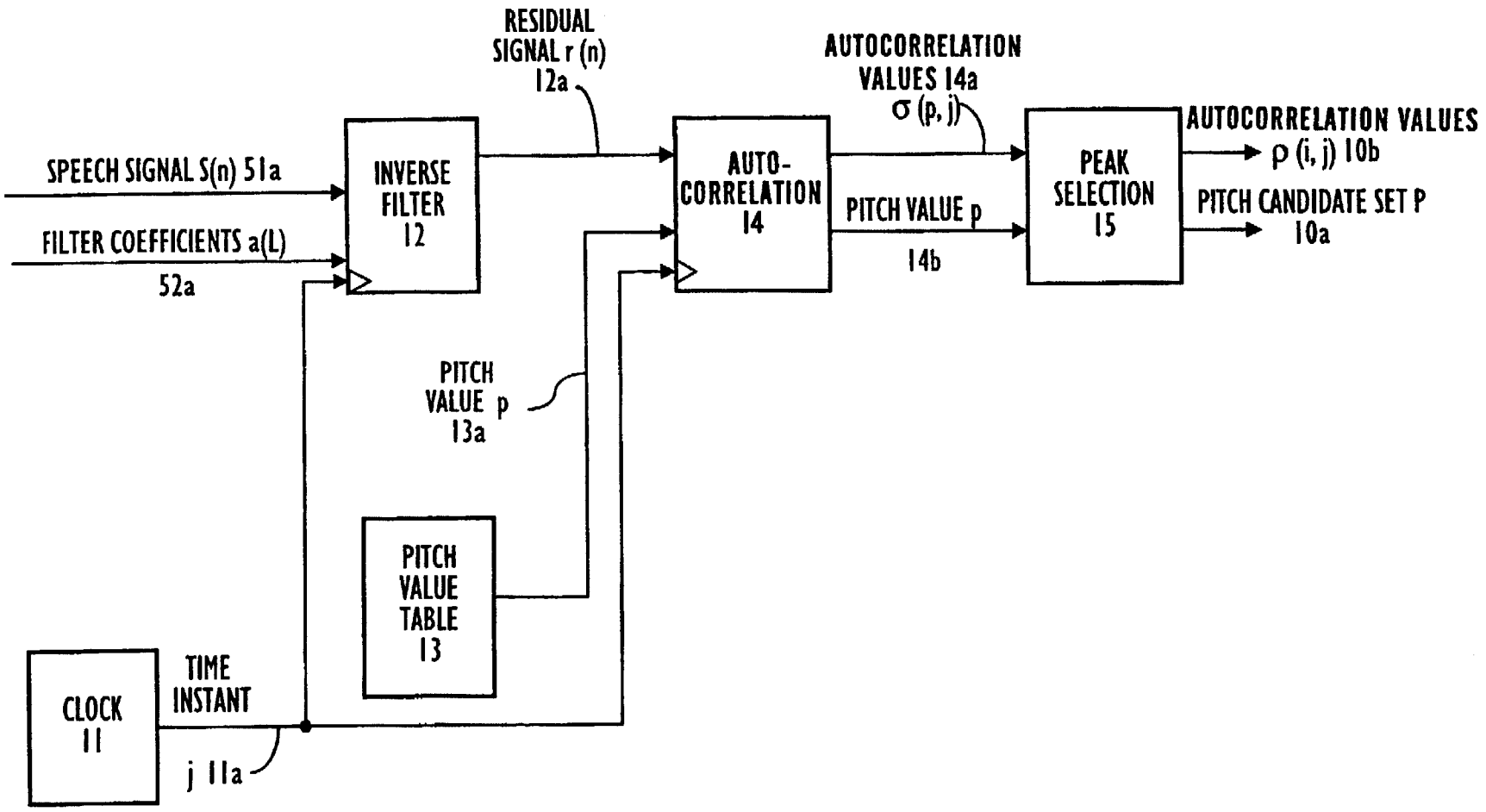
FIG. 3 is a flow chart illustrating the pitch candidate determination stage shown in FIG. 2 in greater detail.

The three stages of pitch estimation will now be discussed in greater detail, with reference to the drawings. As shown in FIG. 3, in the first stage of pitch estimation provided by the present invention, the pitch of the Speech Signal S(n) 51*a* is estimated by analyzing the Speech Signal S(n) 51*a* with a combination of inverse filtering and autocorrelation, respectively represented by the Inverse Filter module 12 and the autocorrelation module 14.

Figure 4:
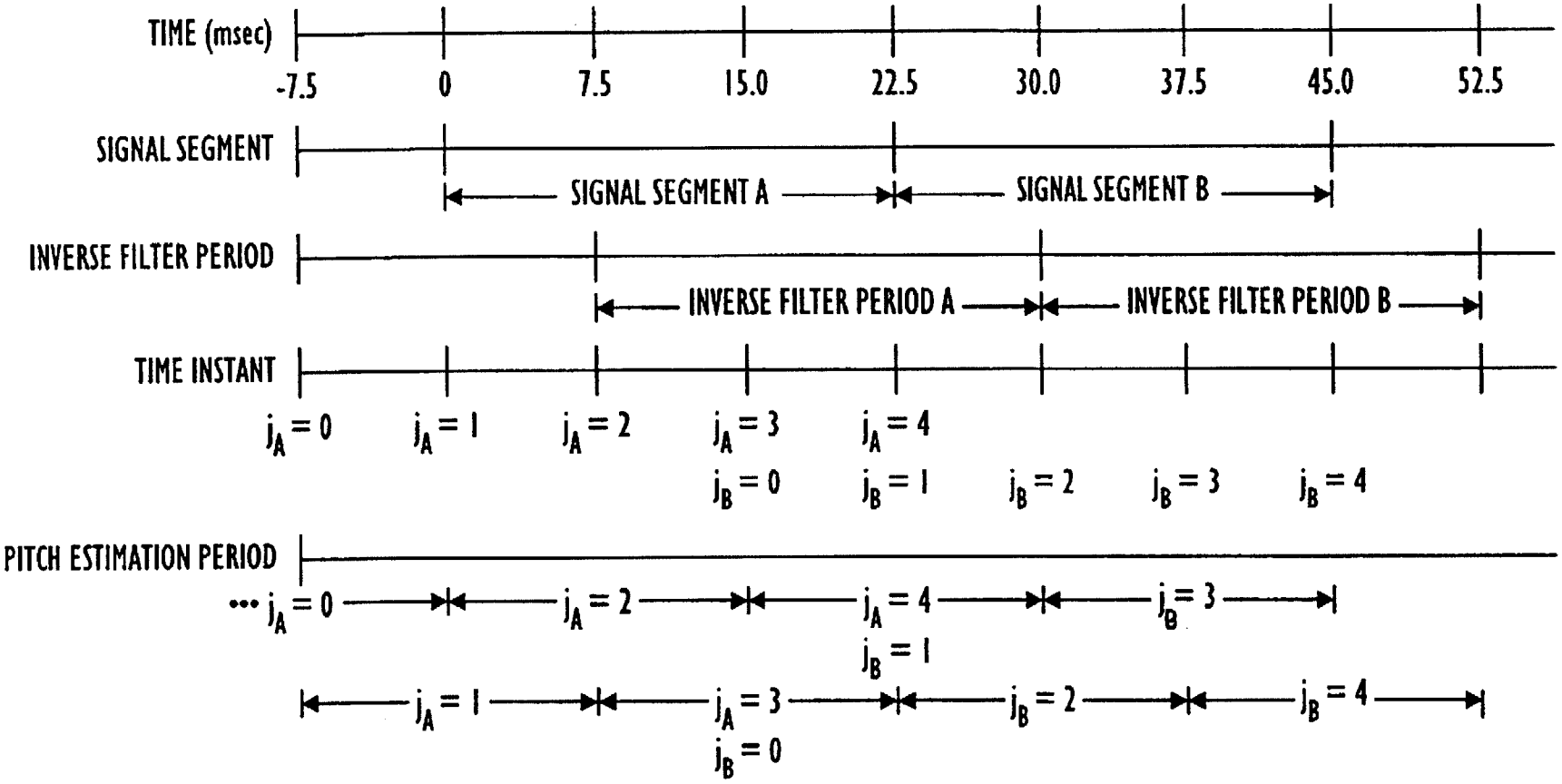
FIG. 4 is a timing diagram illustrating the pitch candidate determination stage shown in FIGS. 2 and 3.

Speech Signal S(n) 51*a* is analyzed in segments defined by time instants j 11*a*, which in turn are determined by a clock 11. In the preferred embodiment, Speech Signal S(n) 51*a* is a digitized speech signal sampled at a frequency of 8 kHz (where n represents the time of each sample—every 0.125 msec at a sampling frequency of 8 kHz). The preferred embodiment of the present invention further defines segments at 22.5 msec intervals and time instants at 7.5 msec intervals. FIG. 4 shows a timing diagram of the preferred embodiment, further showing the time instants in alignment with the boundaries of the speech signal segment.

Referring now to both FIGS. 3 and 4, this first stage of pitch estimation provided by the present invention determines a set of pitch candidates P 10*a* at each time instant j 11*a* by evaluating Speech Signal S(n) 51*a* along with the Filter Coefficients a(L) 52*a* determined by linear prediction analysis 52 (as discussed above with reference to FIG. 2). The Inverse Filter module 12 performs this analysis during an inverse filter period (which, in the preferred embodiment shown in FIG. 4, starts 7.5 msec into the signal segment and continues 7.5 msec after the signal segment ends). Residual Signal r(n) 12*a* is then output, where:

$$r(n) = \sum_{L=0}^{M} S(n-L)a(L)$$

and M is the linear prediction filter order. This process is well known to those with ordinary skill in the art.

Inverse filtered Residual Signal r(n) 12*a* is then Autocorrelation within a 15 msec pitch estimation period centered around each time instant, as shown in the timing diagram of FIG. 4.

Thus, for signal segment A, a set of pitch candidates are determined for 5 time instants: the first 7.5 msec prior to the segment beginning boundary ($j_A$=0), the second at the segment beginning boundary ($j_A$=1), the third 7.5 msec into the segment ($j_A$=2), the fourth 15 msec into the segment ($j_A$=3), and the last, at the segment end ($j_A$=4). One should note that in evaluating any but the first segment of an speech signal, such as signal segment B in FIG. 4, the set of pitch candidates for $j_B$=0 and $j_B$=1 have already been calculated respectively as $j_A$=3 and $j_A$=4 of the previous segment, thus eliminating the need for reevaluation and reducing the real time cost of this first stage.

In the preferred embodiment as illustrated in FIG. 3, a set of possible pitch values for an input speech signal is predetermined and stored in a way as to be easily accessed, such as in a table 13 or a register. The autocorrelation for a potential pitch value p 13*a* at a time instant j 11*a* is calculated according to the formula:

$$\sigma(p,j) = \sum_{n} r(n)r(n-p)$$

where n represents the time of each sample during the time span of time instant j and $P_{min} \leq p \leq P_{max}$, where $P_{min}$ represents the minimum possible pitch value in Pitch Value Table 13 and $P_{max}$ represents the maximum possible pitch value in Pitch Value Table 13.

After Autocorrelation module 14 calculates autocorrelation values σ(p,j) 14*a* for pitch values p 14*b* at a particular time instant j 11*a*, Peak Selection module 15 determines a set of pitch candidates P 10*a*, each representing a pitch value stored in Pitch Value Table 13, to estimate the speech signal pitch at that time instant j 11*a*. Only those "peak" pitch values with the highest autocorrelation values are chosen as pitch candidates.

Each member of the set P 10*a* can be represented as P(i,j), where i is the index into set P 10*a* and j represents the time instant. (In the preferred embodiment, $0 \leq i < 2$, indicating that two pitch values are chosen as pitch candidates to represent the signal at each time instant.) Additionally, for each member P(i,j), the autocorrelation value σ(P(i,j),j) 14*a* will hereinafter be denoted simply as ρ(i,j) 10*b*.

One skilled in the art will recognize that there are numerous methods for storing set P 10*a*, and this invention should not be construed to be limited to specific methods. For example, the pitch value represented by each P(i,j) may be stored in a memory cache or register, or may be referenced by the appropriate entry in the Pitch Value Table 13.

Those skilled in the art will also recognize that while the pitch candidates at the end of the first stage do account for any stationary background noise that may be present in the signal, like prior art pitch estimators, they cannot account for non-stationary spurious contamination. Thus, the present invention goes beyond known pitch estimation by providing a second stage of pitch estimation, constructing an optimal pitch contour for the speech signal from optimal pitch candidates, which are selected from each set of pitch candidates P estimating the pitch of the speech signal at time instant j, as determined in the first stage.

In this second stage, before selecting a particular pitch candidate as the optimal candidate for a particular time instant, the pitch candidates generated for surrounding time instants are also considered. If a particular pitch candidate is inconsistent with the overall contour of the pitch candidates suggested over a period of time, the pitch candidate is likely to reflect non-stationary noise-contaminated speech rather than the speech signal, and is therefore not to be chosen as the optimal candidate.

P(i,j) designates the ith pitch candidate found for time instant j, where $N_p$ pitch candidates were found for $M_p$ time instants. The ultimate objective of this second stage is to select one of the $N_p$ pitch candidates for each of the $M_p$ time instants to create an optimal pitch contour that is the closest fit to the path of the pitch trajectory of the speech signal, taking into account pitch estimate errors caused by spurious contaminants and distortion. The pitch candidate selected is designated as the "optimal" pitch candidate.

First, branch metric analysis is conducted to measure the distortion of the transition from each pitch candidate P(i,j−1) at time instant j−1 to each pitch candidate P(k,j) at time instant j. In the preferred embodiment of this invention, this calculation is formulated as:

$$C(i,k,j)=-\rho(i,j-1)-\rho(k,j)$$

where $0\leqq i,k<N_p$ (where i and k are indices into the set of pitch candidates), $0<j<M_p$ and ρ represents the autocorrelation calculated in the first stage as previously explained. This particular formula was chosen for the preferred embodiment because it provides good results and is easy to implement. One with ordinary skill in the art will recognize that the above formula is merely exemplary, and its use should not be construed as limiting the scope of the present invention.

Using this cost function, the overall path metric is determined, which measures the distortion d(k,j) for a pitch trajectory over the period from the initial time instant to time instant j, leading to pitch candidate P(k,j). The path metric is initialized for the first time instant (j=0) by setting:

$$d(k,0)=-\rho(k,0);\ 0<k<N_p$$

where k is the index into the set of pitch candidates generated for time instant j=0. Optimal path metrics are then calculated for d(k,j) for all k and all j (where $0<j<M_p$), using the formula:

$$d(k,j)=\min_{0\leqq i<Np}(d(i,j-1)+C(i,k,j))$$

where $0\leqq k<N_p$, $0<j<M_p$.

Once the path metric d(k,j) for each pitch candidate k at each time instant j is determined, the optimal mapping is recorded as:

$$I(k,j)=i_{min};\ 0\leqq k<N_p,\ 0<j<M_p$$

where $i_{min}$ is the index for which $d(k,j)=d(i_{min},j-1)+C(i_{min},k,j)$.

Figure 5:
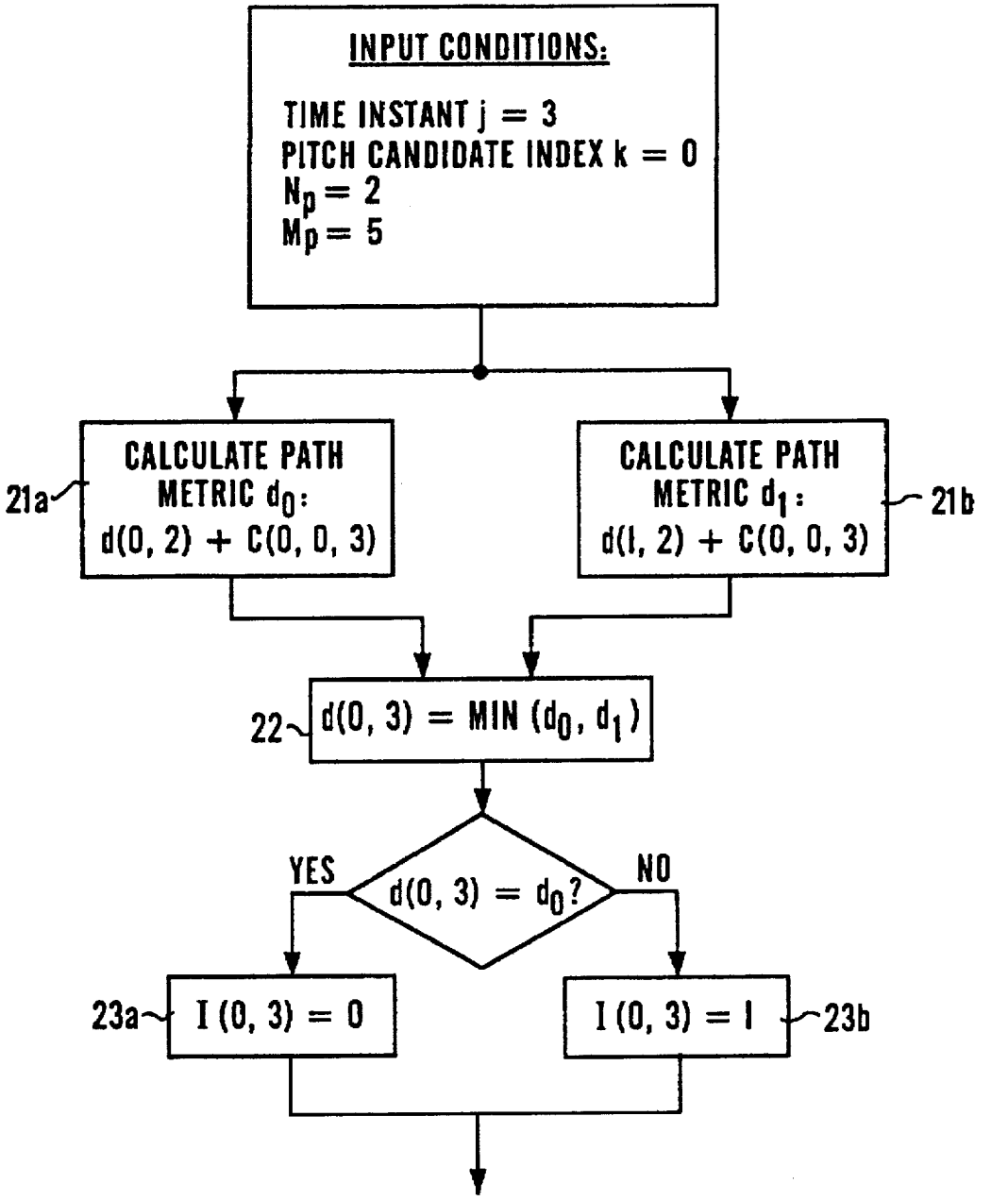
FIG. 5 is a flow chart illustrating the path metric computation in accordance with the present invention.

FIG. 5 illustrates path metric analysis, where there are two pitch candidates chosen to represent the signal pitch at each time instant ($N_p$=2), and the signal is analyzed in segments defined by five time instants ($M_p$=5). The example illustrated shows derivation of the path metric to pitch candidate P(0,3) (i.e., the first of the two pitch candidates for time instant j=3).

By the time d(0,3) is being calculated, d(i,2) has already been calculated for all i. As indicated in FIG. 5, $d_0$ 21*a* represents [d(0,2)+C(0,0,3)] and $d_1$ 21*b* represents [d(1,2)+C(1,0,3)]. These sums $d_0$ 21*a* and $d_1$ 21*b* are compared and d(0,3) is assigned the value min($d_0$, $d_1$) 22. I(0,3) is then set to 0 if $d_0\leqq d_1$, 23*a*, or to 1 if $d_{0>d1}$ 23*b*.

In this example, after d(0,3) and I(0,3) are determined and recorded, d(1,3) and I(1,3) are similarly determined and recorded before going on to determine the path metric for the next time instant d(i,4), for all values of i.

Once all the path metrics are calculated for each time instant and pitch candidate in the signal segment, a traceback procedure is used to obtain optimal pitch candidates for each time instant j as follows:

$$i_{opt}(j)=I(i_{opt}(j+1),j+1)$$

where $0<j+1<M_p$, with the boundary condition that $i_{opt}(M_p-1)$ is the value for which $d(i_{opt}(M_p-1),M_p-1)=\min_{0\leqq k<Np}(d(k,M_p-1))$.

The pitch candidate $P_j=P(i_{opt}(j),j)$ for all time instants j, where $0<j+1<M_p$, is selected from each set P determined in the first stage of the pitch estimation provided by the present invention. The set of all $P_j$ for $0\leqq j<M_p$ defines the optimal pitch contour of the speech signal segment being analyzed, and as with the set P, numerous methods to store this set of pitch candidates $P_j$ will be obvious to those skilled in the art.

Figure 6:
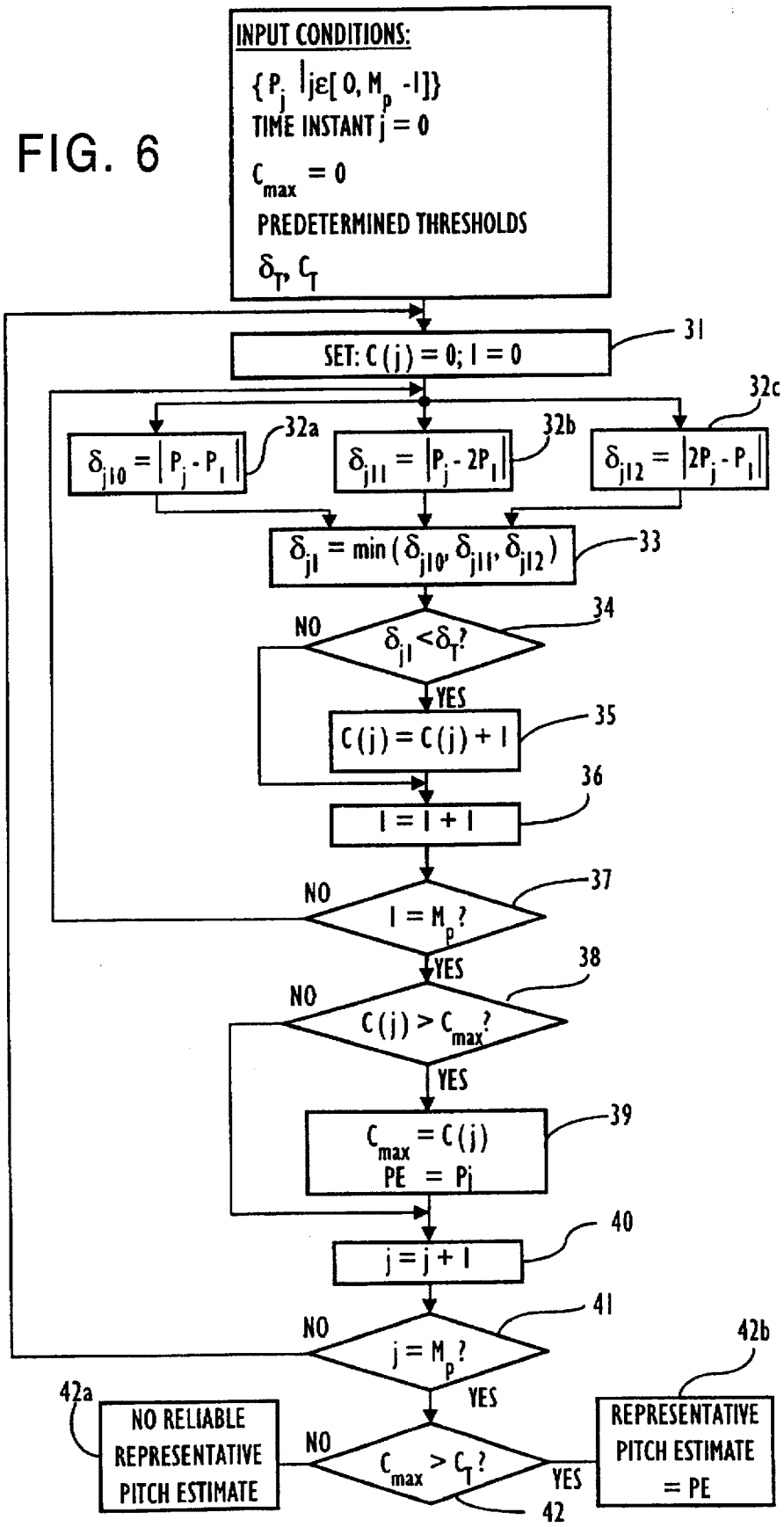
FIG. 6 is a flow chart illustrating the representative pitch candidate selection as provided by the present invention.

A flow chart of the representative pitch estimate selection, the third and final stage of the pitch estimation provided by the present invention, is shown in FIG. 6. As discussed in greater detail below, if the pitch of the speech signal during the segment being analyzed is relatively stable, a single overall pitch estimate will be derived by taking an approximate modal average of the optimal pitch candidates, taking into account the possibility that some of these optimal pitch candidates may be in slight error or could suffer from pitch doubling or pitch halving. If the signal pitch is determined to be insufficiently stable over the signal segment being analyzed, a pitch estimate will not be reliable and no pitch estimation will be made by the present invention.

By this stage, optimal pitch candidates $P_j$ for each time instant j ($0\leqq j<M_p$) has already been selected. The third stage of pitch estimation as provided by the present invention now computes a distance metric $\delta_{jl}$ for each pair $P_j$ and $P_l$ (where j,l represent time instants), as illustrated in FIG. 6, 32*a*, 32*b*, 32*c*, and 33:

$$\delta_{jl0}=|P_j-P_l|$$
$$\delta_{jl1}=|P_j-2P_l|$$
$$\delta_{jl2}=|2P_j-P_l|$$
$$\delta_{jl}=\min(\delta_{jl0},\delta_{jl1},\delta_{jl2})$$

The distance metric $\delta_{jl}$ 33 is an indication of the variation in pitch between time instants within the signal segment being analyzed, and a lower value reflects less variation and suggests that pitch estimation for the overall signal segment may be appropriate. Accordingly, in this stage of the present invention, for every pitch estimate Pj, a counter C(j) is initiated at 0 31, and is incremented 35 each time $\delta_{jl}$ for $0\leqq l<M_p$ falls below a predetermined threshold $\delta_T$ 34.

This process is repeated for all values of j and l, where $0 \leq j,l < M_p$ 36, 37, 40, 41. As these calculations are completed for each j, pitch estimate PE is set to the pitch value represented by $P_j$ if the counter C(j) is the highest counter value calculated so far 39. Once all such calculations are completed, if $C_{max}$, the highest value of C(j) for all j, 38, 39, exceeds a predetermined minimum acceptable value $C_T$ 42, pitch estimate PE is selected as the representative pitch estimate for that signal segment 42b. If $C_{max}$ does not exceed predetermined minimum acceptable value $C_T$ 42, the pitch estimate is discarded as unreliable 42a. As one skilled in the art will recognize, a state of having no reliable pitch estimate can be signalled by various methods, such as generating a specific error signal or by assigning an impossible pitch value (i.e., greater than $P_{max}$ or less than $P_{min}$).

The pitch estimating device and method of the present invention provides numerous advantages by adding the second and third stages to conventional pitch estimation because, as shown above, these additional measures permit a more accurate representation of speech signals even if non-stationary distortion is present, which prior art pitch estimation could not achieve.

Of course, it should be understood that a wide range of changes and modifications can be made to the preferred embodiment described above. It is therefore intended that the foregoing detailed description be regarded as illustrative rather than limiting and that it be understood that it is the following claims, including all equivalents, which are intended to define the scope of this invention.

What is claimed is:

1. A method of estimating the pitch of a digitized speech signal comprising the steps of:

determining a set of pitch candidates to estimate the pitch of the digitized speech signal at each of a plurality of time instants, wherein series of the time instants define segments of the digitized speech signal;

constructing a pitch contour for the digitized speech signal segments using a selected pitch candidate from each of the sets of pitch candidates;

selecting a representative pitch estimate for each of the digitized speech signal segments from the selected pitch candidates constituting the pitch contour by calculating a distance metric value for each pair of selected pitch candidates.

2. The method of pitch estimation according to claim 1 wherein the time instants are defined at 7.5 msec intervals.

3. The method of pitch estimation according to claim 1, wherein the digitized speech signal segments have a duration of 22.5 msec.

4. The method of pitch estimation according to claim 1, wherein the step of determining the set of pitch candidates comprises use of linear prediction analysis to determine filter coefficients to approximate the digitized speech signal.

5. The method of pitch estimation according to claim 4, wherein the step of determining the set of pitch candidates includes inverse filtering the digitized speech signal using the filter coefficients, and autocorrelating the inverse filtered digitized speech signal.

6. The method of pitch estimation according to claim 1, wherein the step of constructing the pitch contour comprises determining, as the selected pitch candidate from each of the pitch candidate sets, the pitch candidate having a minimum path metric distortion value.

7. The method of pitch estimation according to claim 1, wherein the step of selecting the representative pitch estimate for each of the digitized speech signal segments comprises selecting, as the representative pitch estimate, the selected pitch candidate having a maximum number of distance metric values falling below a predetermined threshold.

8. The method of pitch estimation according to claim 7 further comprising the step of generating an error signal if the maximum number of distance metric values falling below the predetermined threshold for the selected representative pitch estimate does not exceed a predetermined minimum acceptable value.

9. A pitch estimator for speech signals comprising:

a clock for measuring a series of time instants;

a sampler coupled to the clock for receiving the speech signals and generating a series of digitized speech segments corresponding to the series of time instants received from the clock;

a register for producing a plurality of different pitch candidates;

a pitch candidate determinator coupled to the sampler for receiving the series of digitized speech segments and coupled to the register for selecting a plurality of pitch candidates from the register to approximate pitch values for the digitized speech segments;

a pitch contour estimator coupled to the pitch candidate determinator for constructing a pitch contour from the pitch candidates selected by the pitch candidate determinator;

a pitch estimate selector coupled to the pitch contour estimator for selecting a pitch estimate from the pitch contour by calculating a distance metric value for each pair of pitch candidates.

10. The pitch estimator according to claim 9, wherein the time instants are defined at 7.5 msec intervals.

11. The pitch estimator according to claim 9, wherein the digitized speech segments have a duration of 22.5 msec.

12. The pitch estimator according to claim 9, wherein the pitch candidate determinator uses linear prediction analysis of the digitized speech segments to determine filter coefficients to approximate the speech signals.

13. The pitch estimator according to claim 9, wherein the pitch contour estimator calculates a path metric value measuring distortion for a pitch trajectory of the digitized speech segments for each of the pitch candidates selected by the pitch candidate determinator, and selects the pitch candidates corresponding to the minimum path metric distortion values.

14. The pitch estimator according to claim 9, wherein the pitch estimate selector selects, as the pitch estimate, the pitch candidate from the pitch contour having a maximum number of distance metric values falling below a predetermined threshold.

15. The pitch estimator according to claim 14, wherein the pitch estimate selector generates an error signal if the maximum number of distance metric values falling below the predetermined threshold for the selected pitch estimate does not exceed a predetermined minimum acceptable value.

* * * * *